US009654890B2

(12) United States Patent
Haber et al.

(10) Patent No.: US 9,654,890 B2
(45) Date of Patent: May 16, 2017

(54) SYSTEM AND METHOD FOR TESTING

(71) Applicant: AUDIO PIXELS LTD., Rehovot (IL)

(72) Inventors: Eric Andreas Haber, Kibbutz Kfar Menahem (IL); Yuval Cohen, Rehovot (IL); Shay Kaplan, Givat Ela (IL); Daniel Lewin, Ramat Hasharon (IL); Meir Ben Simon, Givat Ela (IL)

(73) Assignee: AUDIO PIXELS LTD., Rehovot (IL)

( * ) Notice: Subject to any disclaimer, the term of this patent is extended or adjusted under 35 U.S.C. 154(b) by 0 days.

(21) Appl. No.: 14/655,074

(22) PCT Filed: Nov. 17, 2013

(86) PCT No.: PCT/IL2013/050951

§ 371 (c)(1),
(2) Date: Jun. 24, 2015

(87) PCT Pub. No.: WO2014/102766

PCT Pub. Date: Jul. 3, 2014

(65) Prior Publication Data

US 2015/0350800 A1 Dec. 3, 2015

Related U.S. Application Data

(60) Provisional application No. 61/746,402, filed on Dec. 27, 2012.

(51) Int. Cl.
*H04R 29/00* (2006.01)
*H04R 1/00* (2006.01)

(52) U.S. Cl.
CPC ..... *H04R 29/001* (2013.01); *H04R 1/005* (2013.01); *H04R 29/00* (2013.01)

(58) Field of Classification Search
CPC ..... H04R 29/001; H04R 29/00; H04R 1/005
See application file for complete search history.

(56) References Cited

U.S. PATENT DOCUMENTS

2006/0145059 A1 7/2006 Lee et al.
2010/0002900 A1* 1/2010 Cohen ..... B81B 3/0021 381/396

FOREIGN PATENT DOCUMENTS

WO 2007081584 A2 7/2007
WO 2011111042 A1 9/2011
WO 2012070042 A1 5/2012

* cited by examiner

*Primary Examiner* — MD S Elahee
(74) *Attorney, Agent, or Firm* — Browdy and Neimark, PLLC

(57) ABSTRACT

The present disclosure provides a method for testing an apparatus which comprises a set of operational subunits each comprising a moving element, wherein the moving elements move between respective first and second extreme positions, the method comprising: transferring to the apparatus stabilization control commands; transferring to the apparatus first latching-commands for latching to the first extreme position a candidate moving element which is a moving element of a candidate operational subunit; when the first latching control commands are in effect, measuring a first output frequency of an oscillator whose output is coupled to the candidate operational subunit in an electrical coupling setup which causes the output frequency of the oscillator to depend on positions of a plurality of moving elements which comprises the candidate moving element; and based on the first output frequency determining a state of the candidate operational subunit.

41 Claims, 8 Drawing Sheets

The moving element is positioned in the first extreme position

The moving element positioned in the second extreme position

501

500

500

SYSTEM AND METHOD FOR TESTING

TECHNOLOGICAL FIELD

The present disclosure generally relates to methods and systems for testing an apparatus. More particularly, the present disclosure relates to methods and systems for testing an apparatus comprising a set of operational subunits, wherein each of the operational subunits comprises a moving element moving between respective first and second extreme positions

BACKGROUND

Apparatus comprising a set of operational subunits, wherein each of the operational subunits comprises a moving element moving between respective first and second extreme positions can become stuck. In such apparatus, the moving elements can also become otherwise limited in their movement in a way which prevents them from moving the entire course between the first and second extreme positions or in a way which prevents controlling of their motion using a standard controlling command which they are designed to follow.

GENERAL BACKGROUND

The Applicant has found that it is beneficial to test such apparatus.

Therefore, the present disclosure hereby provides, in a first aspect, a method for testing an apparatus which comprises a set of operational subunits, each of the operational subunits comprising a moving element, wherein each of the moving elements moves between respective first and second extreme positions, the method comprising: transferring to the apparatus stabilization control commands, thereby resulting in maintaining in a static position a moving element of each out of a subset of electrically driven operational subunits out of the set of operational subunits; transferring to the apparatus first latching-commands for latching to the first extreme position a candidate moving element which is a moving element of a candidate operational subunit out of the subset of operational subunits; when the first latching control commands are in effect, measuring a first output frequency of an oscillator whose output is coupled to the candidate operational subunit in an electrical coupling setup which causes the output frequency of the oscillator to depend on positions of a plurality of moving elements which comprises the candidate moving element; and based on the first output frequency determining a state of the candidate operational subunit.

In some embodiments, the measuring of the first output frequency of the oscillator is executed when a location of the candidate moving element is determined by the first latching control commands.

In some embodiments, the determining of the state comprises determining a presence of a defect in the candidate operational subunit.

In some embodiments, the determining of the state comprises determining a position of the moving element of the candidate operational subunit.

In some embodiments, the method comprises transferring to the apparatus second latching control commands for latching the candidate moving element to the second extreme position, and measuring a second output frequency of the oscillator when the second latching control commands are in effect; wherein the determining of the state of the candidate operational subunit is further based on the second output frequency.

In some embodiments, the measuring of the second output frequency of the oscillator when the location of the candidate moving element is determined by the second latching control commands.

In some embodiments, the method comprises transferring to the apparatus the stabilization control commands and the first latching control commands by continuously applying voltages to electrical couplings of the apparatus.

In some embodiments, the transferring of the first latching-commands comprises transferring to the candidate operational subunit varying voltage from an output of a nonlinear switching circuit which is coupled to the candidate operational subunit.

In some embodiments, the measuring of the first output frequency comprises measuring the first output frequency when a target location of each out of a tested-subset of moving elements which comprises the candidate moving element is determined by commands for latching the tested-subset of moving elements to the first extreme position and when a target location of each out of a complementary subset of moving elements, which comprises all moving elements of the set of operational subunits except the tested-subset of moving elements, is determined by commands for latching the complementary subset of moving elements to the second extreme position.

In some embodiments, the tested-subset of moving elements consists of the candidate moving element.

In some embodiments, the method further comprises electrically coupling the output of the oscillator to the candidate operational subunit in the electrical coupling setup, while preventing releasing of the moving elements of the subset of the operational subunits from the static position. The method according to claim 8, further comprising electrically decoupling the electrical driver from the candidate operational subunit before the coupling of the output of the oscillator by ti-stating an output of the electrical driver before the coupling of the output of the oscillator.

In some embodiments, the electrical coupling setup causes the output frequency of the oscillator to depend on capacitances of a plurality of operational subunits which comprises the candidate operational subunit.

In some embodiments, the set of operational subunits comprises a multiplicity of electrostatic operational subunits, each including a moving element moving between first and second electrodes, the multiplicity of electrostatic operational subunits including Nr first subsets (R-subsets) of operational subunits and Nc second subsets (C-subsets) of operational subunits, wherein a first partitioning of the multiplicity of operational subunits yields the Nr first subsets (R-subsets) and a second partitioning of the multiplicity of operational subunits yields the Nc second subsets (C-subsets); wherein the apparatus further comprises: a first plurality of Nr electrical connections (R-wires) interconnecting the moving elements of operational subunits in each R-subset, such that the moving element of any operational subunit in each individual R-subset is electrically connected to the moving elements of all other operational subunits in the individual R-subset, and electrically isolated from the moving elements of all operational subunits not in the individual R-subset; a second plurality of Nc electrical connections (A-wires) interconnecting the first electrodes of operational subunits in each C-subset, such that the first electrode of any operational subunit in each individual C-subset is electrically connected to the first electrode of all other operational subunits in the individual C-subset, and electrically isolated from all operational subunits not in the individual C-subset; and a third plurality of Nc electrical connections (B-wires) interconnecting the second electrodes of operational subunits in each C-subset, such that the second electrode of any operational subunit in each individual C-subset is electrically connected to the second electrode of all other operational subunits in the individual C-subset, and electrically isolated from all operational subunits not in the individual C-subset; wherein the electrical coupling setup causes the output frequency of the oscillator to depend on a sum of the capacitances of Nr operational subunits which are comprised in the C-subset which comprises the candidate operational subunit.

In some embodiments, the method further comprises reiterating for each out of a group of multiple candidate moving elements the stages of: transferring stabilization control commands, transferring first latching-commands, measuring a first output frequency, and determining a state of the candidate operational subunit.

In some embodiments, the apparatus is an apparatus for generating a target physical effect, at least one attribute of which corresponds to at least one characteristic of a digital input signal sampled periodically.

In some embodiments, the candidate moving element is configured to create sound pressure waves in a fluid.

In some embodiments, the candidate moving element is configured to create sound pressure pulses in a fluid.

In some embodiments, the candidate moving element is a part of a sensor that is actuated for the purpose of testing the functionality of said sensor.

In some embodiments, the candidate moving element is a part of a sensor that is actuated for the purpose of calibration of said sensor.

In some embodiments, the set of operational subunits consists of a single subunit.

In a further aspect, the present disclosure provides a system capable of testing an apparatus which comprises a set of operational subunits, each of the operational subunits comprising a moving element which moves between first and second extreme positions the system comprising:

an electrical driver, electrically coupled to the apparatus, configured to:

transfer to the apparatus stabilization control commands, thereby resulting in maintaining in a static position a moving element of each out of a subset of electrically driven operational subunits out of the set of operational subunits; and transfer to the apparatus first latching-commands for latching to the first extreme position a candidate moving element which is a moving element of a candidate operational subunit out of the subset of operational subunits;

oscillator circuitry, configured to be coupled to the candidate operational subunit in an electrical coupling setup which causes the output frequency of the oscillator circuitry to depend on positions of a plurality of moving elements which comprises the candidate moving element; and a processor, configured to:

determine a first output frequency of the oscillator circuitry based on output of the oscillator circuitry when the first latching control commands are in effect; and determine a state of the candidate operational subunit based on the first output frequency.

In some embodiments, the processor is configured to determine a presence of a defect in the candidate operational subunit by determining its state.

In some embodiments, the processor is configured to determine the first output frequency of the oscillator circuitry based on the output of the oscillator circuitry when a target location of the candidate moving element is determined by the first latching control commands.

In some embodiments, the processor is configured to determine a position of the moving element of the candidate operational subunit by determining its state.

In some embodiments, the system further comprises the apparatus which comprises the set of operational subunits.

In some embodiments, the processor is further configured to determine the stabilization control commands.

In some embodiments, the electrical driver is further configured to transfer to the apparatus second latching control commands for latching the candidate moving element to the second extreme position, wherein the processor is configured to determine a second output frequency of the oscillator circuitry based on output of the oscillator circuitry when the second latching control commands are in effect; and to determine the state of the candidate operational subunit based on the first output frequency and on the second output frequency.

In some embodiments, the processor is configured to determine the second output frequency of the oscillator circuitry based on the output of the oscillator circuitry when a location of the candidate moving element is determined by the second latching control commands.

In some embodiments, the electrical driver is configured to transfer to the apparatus the stabilization control commands and the first latching control commands by continuously applying voltages to electrical couplings of the apparatus.

In some embodiments, the electrical driver is configured to transfer to the candidate operational subunit the first latching-commands which comprise varying voltage from an output of a nonlinear switching circuit of the oscillator circuitry which is coupled to the candidate operational subunit.

In some embodiments, the processor is configured to determine the first output frequency based on output of the oscillator circuitry when a target location of each out of a tested-subset of moving elements which comprises the candidate moving element is determined by commands for latching the tested-subset of moving elements to the first extreme position and when a target location of a complementary subset of moving elements, which comprises all moving elements of the set of operational subunits except the tested-subset of moving elements, is determined by commands for latching the complementary subset of moving elements to the second extreme position.

In some embodiments, the tested-subset of moving elements consists of the candidate moving element.

In some embodiments, the oscillator circuitry may be selectively electrically decoupled from the set of operational subunits.

In some embodiments, the electrical coupling setup causes the output frequency of the oscillator circuitry to depend on capacitances of a plurality of operational subunits which comprises the candidate operational subunit.

In some embodiments, the set of operational subunits comprises a multiplicity of electrostatic operational subunits, each including a moving element moving between first and second electrodes, the multiplicity of electrostatic operational subunits including Nr first subsets (R-subsets) of operational subunits and Nc second subsets (C-subsets) of operational subunits, wherein a first partitioning of the multiplicity of operational subunits yields the Nr first subsets (R-subsets) and a second partitioning of the multiplicity of operational subunits yields the Nc second subsets (C-subsets); wherein the apparatus further comprises:

a first plurality of Nr electrical connections (R-wires) interconnecting the moving elements of operational subunits in each R-subset, such that the moving element of any operational subunit in each individual R-subset is electrically connected to the moving elements of all other operational subunits in the individual R-subset, and electrically isolated from the moving elements of all operational subunits not in the individual R-subset;

a second plurality of Nc electrical connections (A-wires) interconnecting the first electrodes of operational subunits in each C-subset, such that the first electrode of any operational subunit in each individual C-subset is electrically connected to the first electrode of all other operational subunits in the individual C-subset, and electrically isolated from all operational subunits not in the individual C-subset; and a third plurality of Nc electrical connections (B-wires) interconnecting the second electrodes of operational subunits in each C-subset, such that the second electrode of any operational subunit in each individual C-subset is electrically connected to the second electrode of all other operational subunits in the individual C-subset, and electrically isolated from all operational subunits not in the individual C-subset;

wherein the electrical coupling setup causes the output frequency of the oscillator circuitry to depend on a sum of the capacitances of Nr operational subunits which are comprised in the C-subset which comprises the candidate operational subunit.

In some embodiments, the oscillator circuitry may be coupled to different operational subunits in different times, wherein the processor is configured to determine states of multiple operational subunits based on output frequencies of the oscillator circuitry in the different times.

In some embodiments, the apparatus is an apparatus for generating a target physical effect, at least one attribute of which corresponds to at least one characteristic of a digital input signal sampled periodically.

In some embodiments, the candidate moving element is configured to create sound pressure waves in a fluid.

In some embodiments, the candidate moving element is configured to create sound pressure pulses in a fluid.

In some embodiments, the candidate moving element is a part of a sensor that is actuated for the purpose of testing the functionality of said sensor.

In some embodiments, the candidate moving element is a part of a sensor that is actuated for the purpose of calibration of said sensor.

In some embodiments, the set of operational subunits consists of a single subunit.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF THE EMBODIMENTS

Figure 1:
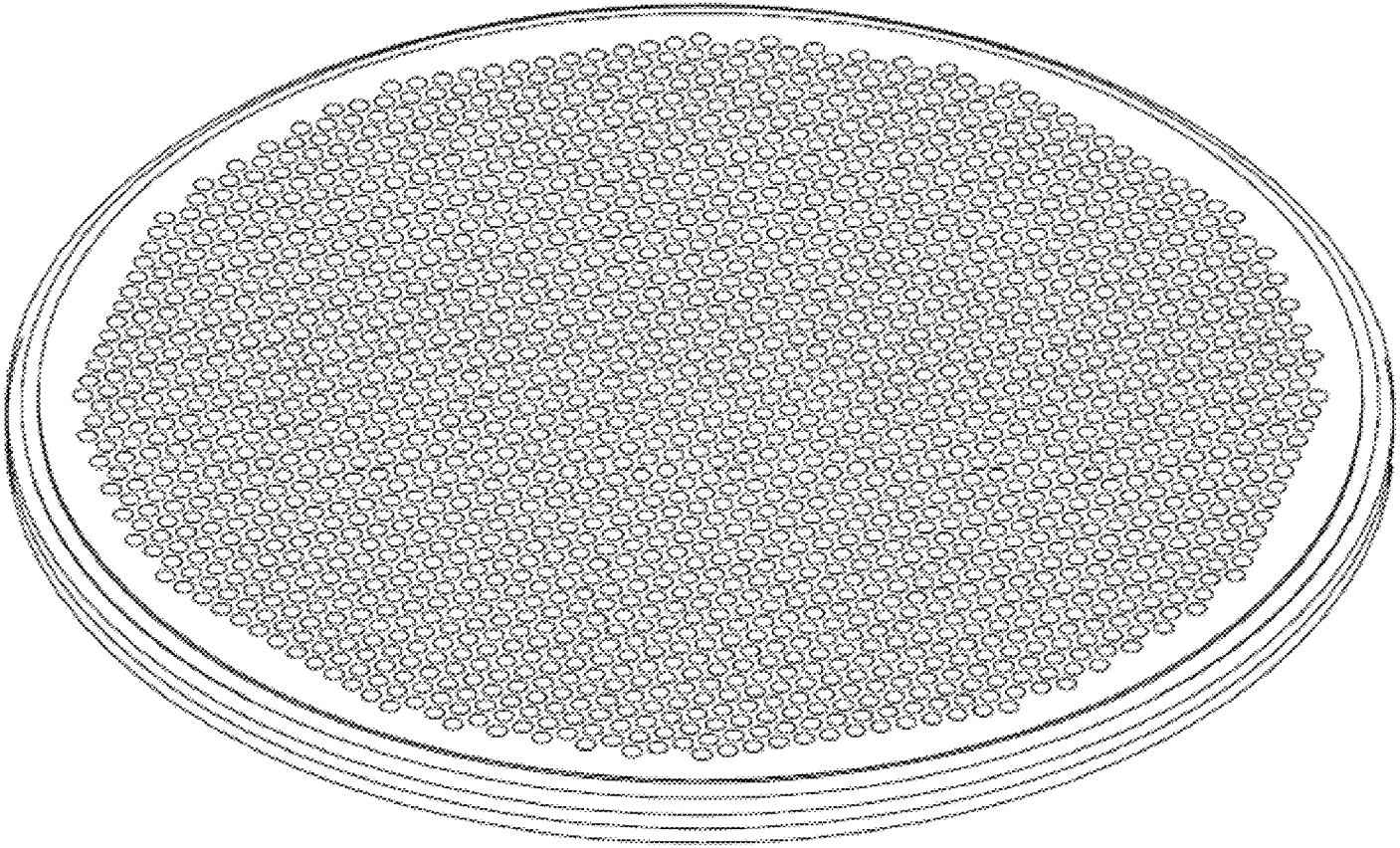
FIG. 1 illustrates an array including multiple actuator elements which may be used to produce a sound wave.

In order to understand the invention and to see how it may be carried out in practice, embodiments will now be described, by way of non-limiting example only, with reference to the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

In the drawings and descriptions set forth, identical reference numerals indicate those components that are common to different embodiments or configurations.

Unless specifically stated otherwise, as apparent from the following discussions, it is appreciated that throughout the specification discussions utilizing terms such as "processing", "calculating", "computing", "determining", "generating", "setting", "configuring", "selecting", "defining", or the like, include action and/or processes of a computer that manipulate and/or transform data into other data, said data represented as physical quantities, e.g. such as electronic quantities, and/or said data representing the physical objects. The terms "computer", "processor", and "controller" should be expansively construed to cover any kind of electronic device with data processing capabilities, including, by way of non-limiting example, a personal computer, a server, a computing system, a communication device, a processor (e.g. digital signal processor (DSP), a microcontroller, a field programmable gate array (FPGA), an application specific integrated circuit (ASIC), etc.), any other electronic computing device, and or any combination thereof.

The operations in accordance with the teachings herein may be performed by a computer specially constructed for the desired purposes or by a general purpose computer specially configured for the desired purpose by a computer program stored in a computer readable storage medium.

As used herein, the phrase "for example," "such as", "for instance" and variants thereof describe non-limiting embodiments of the presently disclosed subject matter. Reference in the specification to "one case", "some cases", "other cases" or variants thereof means that a particular feature, structure or characteristic described in connection with the embodiment(s) is included in at least one embodiment of the presently disclosed subject matter. Thus the appearance of the phrase "one case", "some cases", "other cases" or variants thereof does not necessarily refer to the same embodiment(s).

It is appreciated that certain features of the presently disclosed subject matter, which are, for clarity, described in the context of separate embodiments, may also be provided in combination in a single embodiment. Conversely, various features of the presently disclosed subject matter, which are, for brevity, described in the context of a single embodiment, may also be provided separately or in any suitable sub-combination.

In embodiments of the presently disclosed subject matter one or more stages illustrated in the figures may be executed in a different order and/or one or more groups of stages may be executed simultaneously and vice versa. The figures illustrate a general schematic of the system architecture in accordance with an embodiment of the presently disclosed subject matter. Each module in the figures can be made up of any combination of software, hardware and/or firmware that performs the functions as defined and explained herein. The modules in the figures may be centralized in one location or dispersed over more than one location.

Figure 2A:
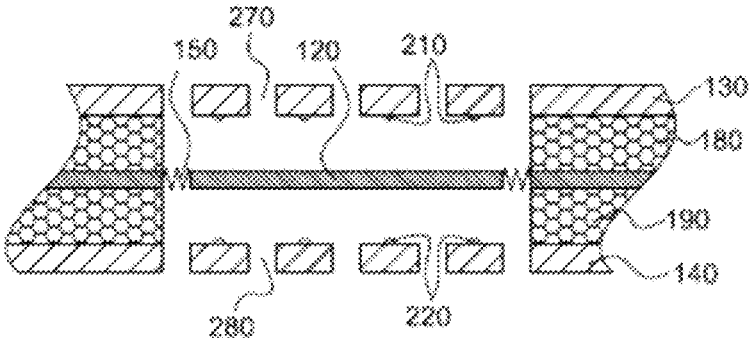
FIGS. 2A-2C are cross-sectional illustrations of an individual actuator element which may be implemented in the array of FIG. 1.
Figure 2B:
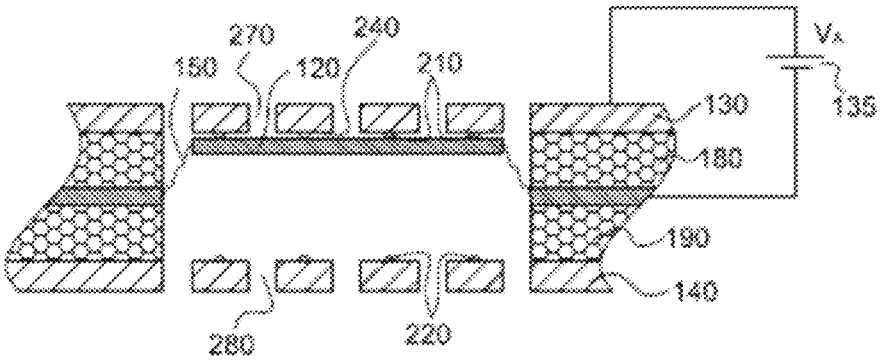
Figure 2C:
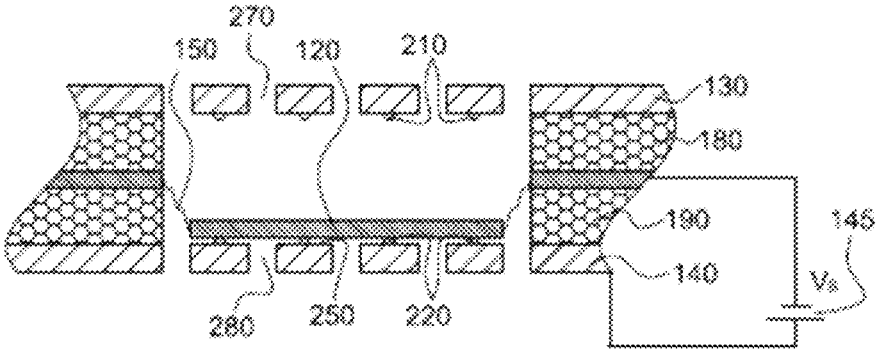

FIG. 1 illustrates an array which includes multiple elements, and FIGS. 2A, 2B and 2C illustrate an individual element which may be implemented in such an array, according to an embodiment of the invention. Each of the plurality of circular elements in FIG. 1 represents a single such element.

The array of FIG. 1 may be used, for example, to produce a physical effect such as a sound wave (or another pressure wave). In such case, the physical effect produced by an individual element (which is in such case referred to as "actuator element") is a pressure pulse, and the overall physical effect produced by the entire apparatus is audible sound. In that case, the entire apparatus may serve as a digital-to-analog converter (DAC) whose analog output is sound pressure (rather than voltage or current, like most DACs).

Reference is now made to FIGS. 2A to 2C which are cross-sectional illustrations of one type of double-sided electrostatic actuator elements, according to an embodiment of the invention. The actuator element includes a moving element 120 mechanically connected to the stationary portions of the actuator element by means of a suitable flexure 150 such as a flexure or spring. The flexure 150 defines an axis 125 along which the moving element 120 can travel, prevents the moving element 120 from travelling in other directions, and defines an at-rest position of the moving element 120. The actuator element further includes two electrodes 130 and 140, also referred to hereinafter as "A-electrode" and "B-electrode" respectively, disposed on opposite sides of the moving element 120. The moving element 120 is separated from the electrodes 130 and 140 by spacers 180 and 190. Dimples 210 and 220 are formed on the surfaces of the electrodes 130 and/or 140 respectively which each face the moving element 120.

FIG. 2A shows the moving element 120 in its resting position, with no voltage applied between the moving element 120 and either electrode 130 and 140. Applying a voltage between the moving element and either electrode produces an electrostatic force attracting the moving element towards that electrode, the magnitude of the electrostatic force being proportional to the magnitude of the voltage applied, and inversely proportional to the square of the separation distance between facing surfaces of moving element 120 and the respective electrode. At the same time, any movement of the moving element 120 away from its resting position causes flexure 150 to exert on the moving element 120 a spring force pulling it back towards its resting position. Moving element 120 may also be affected by other forces such as damping or friction forces which may either occur naturally or be deliberately introduced for practical reasons such as to improve long-term reliability. However, such additional forces are not required for the purpose of the present invention. The moving element 120 may reach an equilibrium position where the sum of all forces acting on it is zero, or it may be latched as described under FIGS. 2B and 2C.

FIG. 2B shows moving element 120 latched in a first extreme position, as close as possible to A-electrode 130 and as far as possible from B-electrode 140, also referred to hereinafter as the "A-position". Typically, moving element 120 reaches this position as a result of a voltage $V_A$ being applied between A-electrode 130 and moving element 120, generating an electrostatic force, also referred to hereinafter as "A-force", attracting moving element 120 towards A-electrode 130. As moving element 120 approaches A-electrode 130, the A-force increases inversely proportional to the square of the separation distance between facing surfaces of moving element 120 and electrode 130, whereas the spring force pulling moving element 120 back towards its resting position increases proportionally to its deflection from its resting position. Depending on the spring constant of flexure 150 and on the range of $V_A$, a critical point may exist along axis 125 where A-force and the spring force are equal and any further travel of moving element 120 towards A-electrode 130 causes the A-force to grow more quickly than the spring force. If moving element 120 moves even marginally beyond this critical point, and assuming that $V_A$ remains constant, the balance of forces causes moving element 120 to accelerate towards A-electrode 130 until it makes contact with dimples 210, a process referred to hereinafter as "latching". After latching, the magnitude of $V_A$ sufficient to hold moving element 120 in this position (referred to hereinafter as "hold voltage"), is smaller than the magnitude of $V_A$ sufficient to achieve latching of moving element 120 into the A-position (referred to hereinafter as "latching voltage").

When moving element 120 is latched in the A-position and a second voltage $V_B$ is applied between B-electrode 140 and moving element 120, the electrostatic force resulting from $V_B$ is significantly smaller in magnitude than the A-force resulting from a $V_A$ of equal magnitude. Hence, the presence of a non-zero $V_B$ only marginally increases the magnitude of the hold voltage sufficient to keep moving element 120 latched in the A-position.

If $V_A$ subsequently falls below the hold voltage, the A-force becomes smaller in magnitude than the spring force, causing moving element 120 to move away from the A-position and towards its resting position, a process referred to hereinafter as "release". With both $V_A$ and $V_B$ equal to zero, moving element 120 then oscillates around its resting position with its frequency of oscillation, also referred to hereinafter as its "mechanical resonance frequency", determined primarily by the mass of moving element 120 and the spring constant of flexure 150 (neglecting damping), and the amplitude of oscillation gradually decreasing as a result of friction, damping or other energy loss. Alternatively, in the presence of a non-zero $V_B$ of sufficient magnitude, moving element 120 is latched into a second extreme position, as close as possible to B-electrode 140 and as far as possible from A-electrode 130, also referred to hereinafter as the "B-position".

According to one embodiment of the present invention, the controller may adjust $V_A$ and $V_B$ such that moving element 120 is always either in the A-position or the B-position, or transitioning between these two positions; i.e. during normal operation, moving element 120 never settles in its resting position or any other position except the two extreme positions.

When moving element 120 reaches its resting position during transitions between the two extreme positions, it has non-zero kinetic energy and linear velocity relative to electrodes 130 and 140 and therefore continues to travel towards its new extreme position until its kinetic energy is absorbed by flexure 150. Since latching moving element 120 from a position closer to its new extreme position requires a lower electrostatic force than latching moving element 120 into that same extreme position from equilibrium at its resting position, latching voltages are lower for transitions between extreme positions than for latching from rest.

Dimples 210 may be implemented, for example, in order to reduce stiction between the respective electrode and the moving element, in order to allow air to flow through holes 270 in the respective electrode and into the space between the moving element and that electrode, and so on.

FIG. 2C shows the moving element 120 latched in the B-position, as close as possible to electrode 140 and as far as possible from electrode 130. Latching of the moving element 120 into the B-position and release from the B-position may be achieved in a manner analogous to that described under FIG. 2B above, reversing the roles of A-electrode 130 and B-electrode 140, that of $V_A$ and $V_B$, and that of A-force and B-force.

Suitable materials and manufacturing techniques for the production of actuator elements as shown in FIGS. 2A-2C and closely related types of actuator elements are discussed in co-owned WO2011/111042 ("Electrostatic Parallel Plate Actuators Whose Moving Elements Are Driven Only By Electrostatic Force and Methods Useful in Conjunction Therewith"), published 15 Sep. 2011.

Also, other electrical control schemes may be used, e.g. as described in co-owned PCT application PCT/IL2011/050018, entitled "Apparatus and Methods for Individual Addressing and Noise Reduction in Actuator Arrays".

An array which includes a plurality of moving elements (e.g. such as illustrated in FIG. 1) may be used for other uses as well. For example, such an array may be used as a sensor. In such a case, the positions moving elements may be sensed and analyzed to provide sensing results, such as—direction of sound source, distance of sound source, and so on. Each moving element in such an implementation do not belong to an actuator element, but rather to a sensing operational subunit.

Referring generally an apparatus which includes a plurality of moving elements and in which each moving element moves between respective first and second extreme positions (e.g. the aforementioned "A-position", as close as possible to A-electrode 130 and as far as possible from B-electrode 140 and the aforementioned "B-position", as close as possible to B-electrode 140 and as far as possible from A-electrode 130, respectively).

Clearly, in some situations, some of the moving elements which are designed to move between the respective first and second extreme positions may become stuck or otherwise limited in their movement in a way which prevents them from moving the entire course between the first and the second extreme positions, and in the other ways. Even if moving elements are not faulty in a way which prevents them from actually moving between these two extreme positions, they may be faulty in a way which prevent a controlling of their motion using the standard controlling command which they are designed to follow.

Reasons for a defective operational subunit (in which the movement of the moving element is restricted in any such way) may vary. But a few examples for such reasons are:

a. Dust, debris or other mechanical hindrances may enter the movement route of the moving element and prevent it from freely moving in this route.
b. The moving element may be defective (e.g. torn, broken, etc.).
c. Means guiding the movement of the moving element may be torn, broken, or disfigured.
d. The electrical parameters of the moving element and/or of external electrical components (such as electrodes A and B) may differ from the original design (e.g. due to corrosion, manufacture defect, and so on).
e. Electrical connections may be short-circuited.

The systems and methods discussed below may be used for determining whether one (or more) of the moving elements of the apparatus may reach different positions along its path between the first and second extreme position, and especially these extreme positions.

In the apparatus tested, the moving element may come closer and farther from an electrode (referring to the example of FIG. 2, electrode A 130 or electrode B 140). Since both the moving element 120 and the respective electrode are electrically conductive and connected to larger electrical circuitries respectively, these elements form a capacitor whose capacitance vary with the changing of the distance between the moving element 120 and the respective electrode.

Figure 3A:
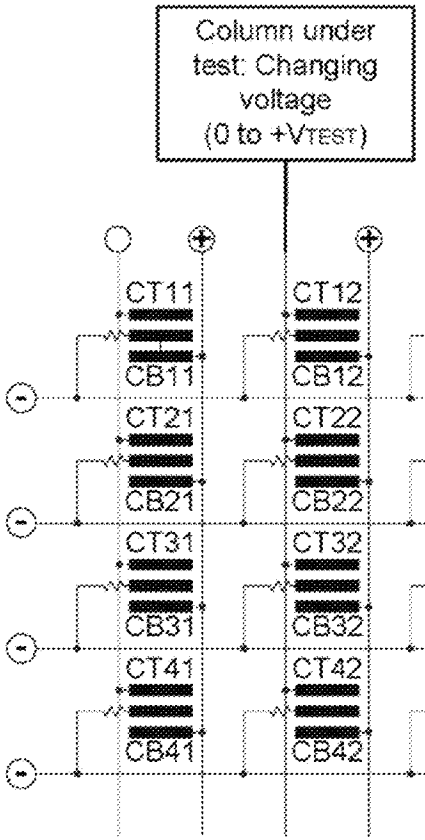
FIG. 3A is an electrical diagram of an apparatus that includes a 4*4 matrix of actuator elements and FIG. 3B is an equivalent electrical circuit.

FIG. 3A is an electrical diagram of an apparatus that includes a 4 by 4 matrix of operational subunits (e.g. actuator elements). In the illustrated example, each moving element 120 (for the sake of simplicity of the drawing, numeral references are indicated only for one of the operational subunits 101) is electrically connected to all of the other moving elements of the same row. Each top electrode 130 ("electrode A", also denoted CT for Column-Top) is electrically connected to all of the other top electrodes of the same column, and each bottom electrode 140 ("electrode B", also denoted CB for Column-Bottom) is electrically connected to all of the other bottom electrodes of the same column.

Considering the capacitors which are created between the moving elements of all of the operational subunits 101 and the respective top electrodes of these operational subunits 101, it is clear that a complex circuit of a network of capacitors is generated. In order to change the voltage across one of these capacitors, one must change the voltage applied to the top electrode of the entire column of the respective operational subunit and/or the voltage applied to the moving elements of the entire row of the respective operational subunit. Such modifying of voltage naturally results in a current whose value depends on the capacitance of the capacitor of the relevant operational subunit. However, it will be clear to a person who is of skill in the art that the current also depends on the capacitance of other capacitors (in other operational subunits) of the network (e.g. capacitors of the same column, capacitors of the same row, parasitic capacitance, etc.).

It is noted that even if the control voltages are otherwise shared between different operational subunits (i.e. not in full rows and columns as illustrated), sharing a continuous conductivity between parts of different operational subunits would result in complex capacitance interrelationships.

It should be noted that the capacitance of a single operational subunit may also depend on the physical characteristics of other parts in addition to these of the moving elements and the respective electrodes. For example, the capacitance may also depend on the capacitance generated by suitable flexure 150 (e.g. a flexure or a spring or a membrane, and so on).

Figure 4:
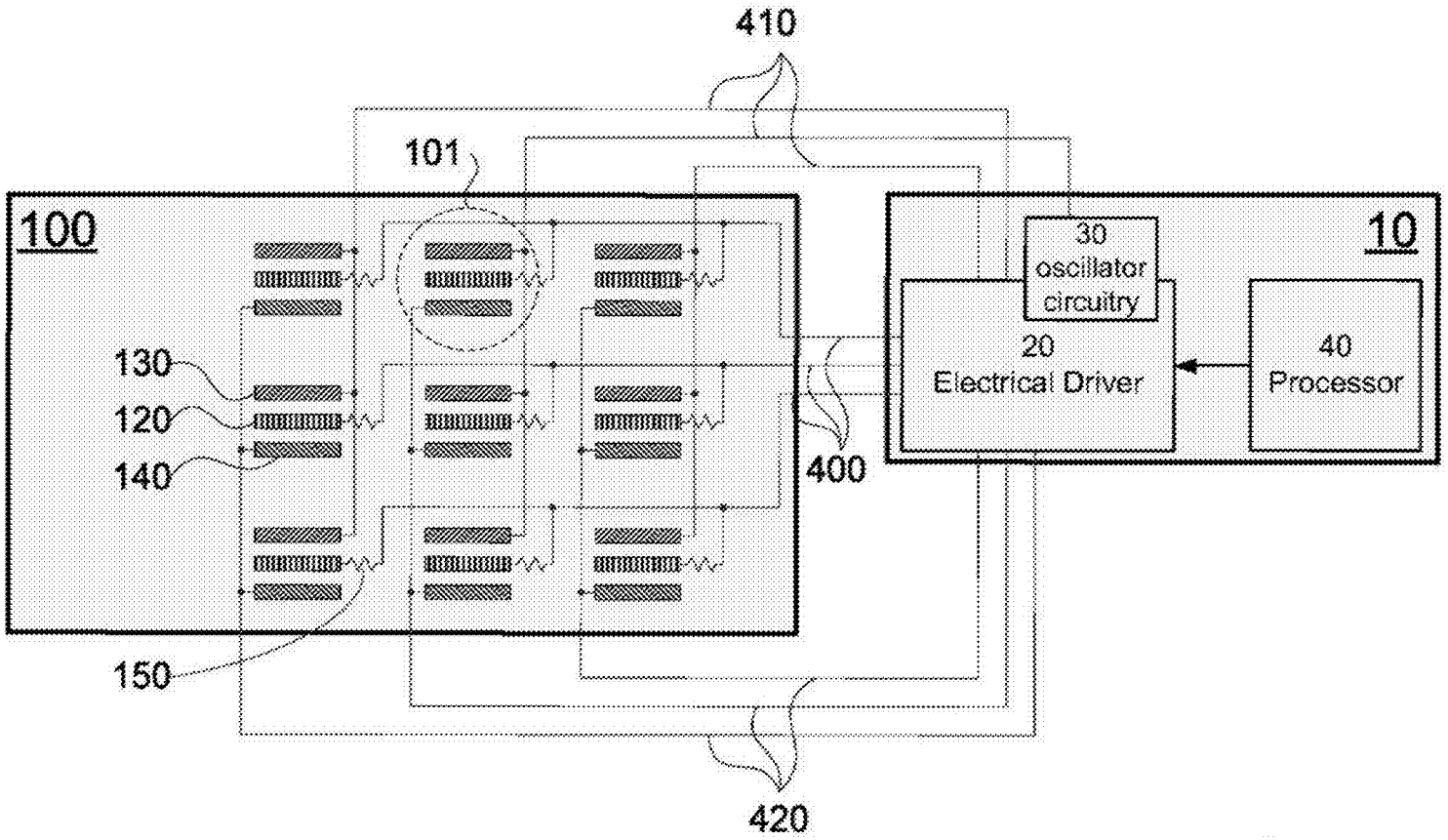
FIG. 4 is a block diagram of a system which is capable of testing an apparatus including a set of operational subunits according to some embodiments of the present disclosure.

FIG. 4 is a block diagram of a system 10 which is capable of testing an apparatus 100 which includes a set of operational subunits (e.g. actuator elements) 101, according to an embodiment of the invention. Each of the operational subunits 101 includes a moving element 120 which moves between first and second extreme positions (e.g. as illustrated in FIGS. 2B and 2C). System 10 includes at least electrical driver 20, oscillator circuitry 30, and processor 40. It should be noted that while system 10 is illustrated as external to apparatus 100, it may be implemented as a single system, possibly sharing components (such as electrical driver 20, controller/processor 40, electrical connections, physical structure and support, and so on).

For reasons of convenience, a method for testing according to which system 200 may operate will be discussed prior to an independent discussion of system 10. Firstly, a simple example will be provided of method 501, which is followed by a description of a more general method 500.

Figure 6:
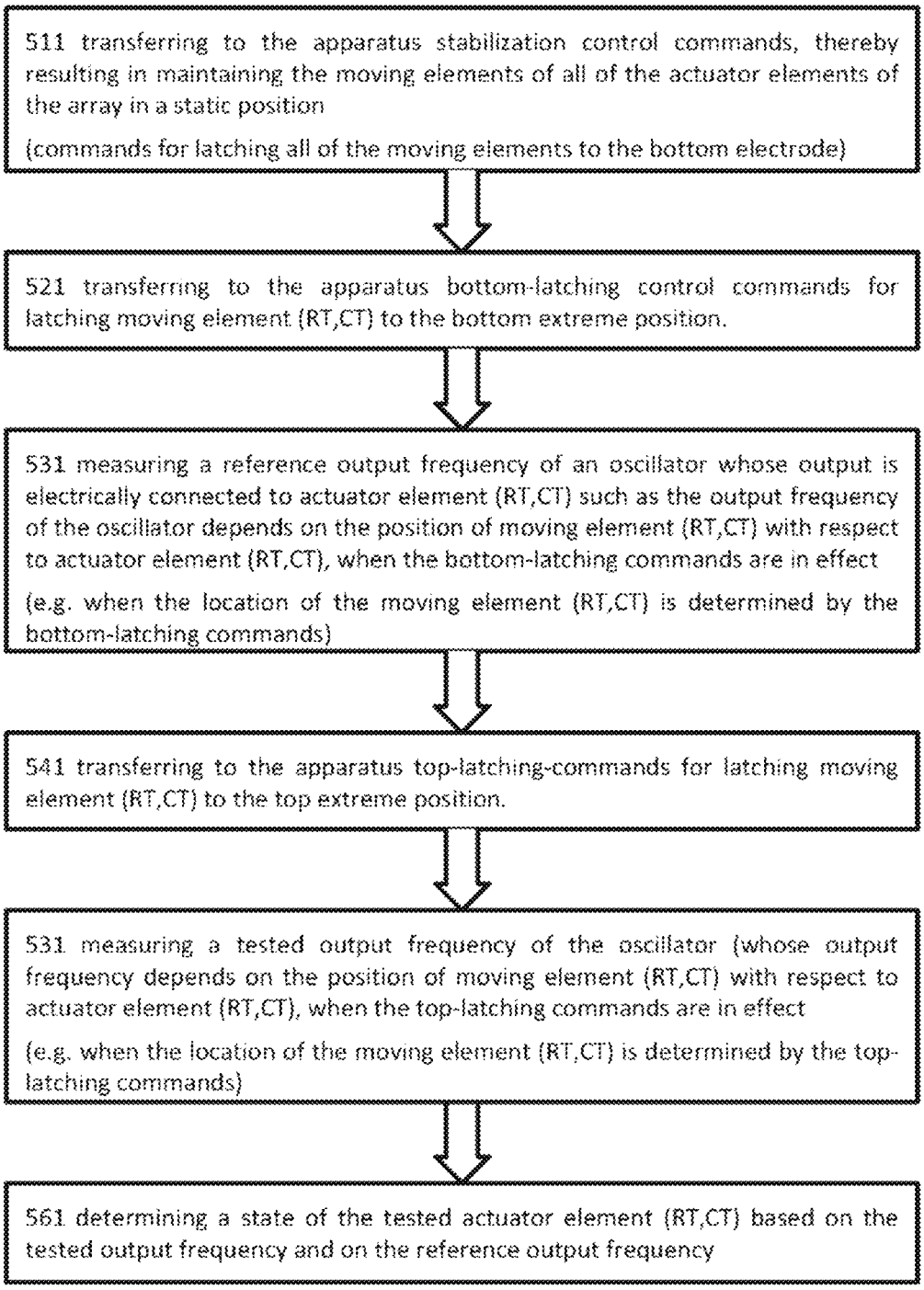
FIG. 6 is a flow chart of a method for testing an apparatus which includes a set of actuator elements according to some embodiments of the present disclosure.

FIG. 6 is a flow chart of method 501 for testing an apparatus which includes a set of actuator elements, each of the actuator elements includes a moving element, wherein each of the moving elements moves between respective first and second extreme positions.

Method 501 is used for testing an apparatus which includes a multiplicity of electrostatic actuator elements which includes Nr rows of actuator elements and Nc columns of actuator elements. Each actuator elements belongs to a single row and to a single column. Referring to the example of FIG. 4, Nc=Nr=3. The electrical connections between different moving elements and between electrodes A and B of the different actuator elements are as described above.

Specifically, method 501 will be described as a method for testing a single actuator element of the array (located, for example, at row and column $(R_T,C_T)$). Even more specifically, method 501 will be described as a method for testing whether the actuator element $(R_T,C_T)$ responds to commands to progress to the first extreme position, which is in this case assumed to be the top electrode.

Stage 511 of method 501 includes transferring to the apparatus stabilization control commands, thereby resulting in maintaining the moving elements of all of the actuator elements of the array in a static position. Specifically, stage 511 includes transferring to the apparatus control commands intended to bring the moving elements of all of the actuator elements of the array to the second extreme position, closest to the bottom electrodes. If some of the elements are defective, such a command may not result in their progression towards the bottom electrode, but would rather stabilize them in a static position different from the second extreme position.

As will be described below, the ability of actuator element $(R_T,C_T)$ to progress towards top electrode will be based on an indirect measuring of capacitance between its moving element (and other moving elements) to the top electrodes of the respective actuator elements.

When all of the moving elements are in the bottom position, the capacitance between them and the respective top electrodes is the smallest, and thus changes in capacitance will be most noticeable.

The stabilization control commands transferred in stage 511 may include applying a negative voltage to all of the moving elements of the array, and applying a positive voltage to all of the bottom electrodes (as illustrated for example in FIG. 3), thereby creating sufficient attraction to latch the moving elements of all of the properly functioning actuator elements to the bottom position. Faulty actuator elements are supposed to remain in a static position, even if not latched to the bottom electrode.

Stage 521 includes transferring to the apparatus bottom-latching control commands for latching moving element $(R_T,C_T)$ (i.e. the moving element of actuator element $(R_T,C_T)$) to the bottom extreme position. It is noted that the stabilization commands transferred in stage 511 may also include the bottom-latching control commands (for example, the voltages indicated in FIG. 3 would serve both tasks).

Stage 531 includes measuring a reference output frequency of an oscillator whose output is electrically connected to actuator element $(R_T,C_T)$ such as the output frequency of the oscillator depends on the position of moving element $(R_T,C_T)$ with respect to actuator element $(R_T,C_T)$ (and especially with respect to its top electrode). The measuring of stage 531 is executed when the bottom-latching control commands are in effect (and when the location of the moving element $(R_T,C_T)$—if it is functional—is determined by the bottom-latching control commands).

Within the scope of the present disclosure, a location of a moving element is determined by a command (e.g. by voltage applied to that element) when the location is effected by the command, even if other factors also effect this location. For example, the location of a moving element of an operational subunit is determined by the difference of voltages between this moving element and a respective electrode (e.g. the bottom electrode), even though other factors also effect this location—such as any voltage difference with the top electrode, mechanical forces applied by the flexures, potential magnetic fields, particles that behave as a mechanical stop, friction, density of the medium in which the element moves (e.g. air), and so on.

The location of the moving element is said to be determined by the control command if it was different under identical conditions with the exception of this control command (e.g. when another voltage was applied by the respective electrode). It will be clear to a person who is of skill in the art that since the latching commands are intended to have significant effect on the location of the moving element, the difference between the location of the moving element when the control command is applied to its potential location if it wasn't applied is usually significant with respect to the distance between the two extreme positions of this moving element (e.g. at least 30% for a properly functioning element, possibly less than that for a somewhat defective element).

Figure 3B:
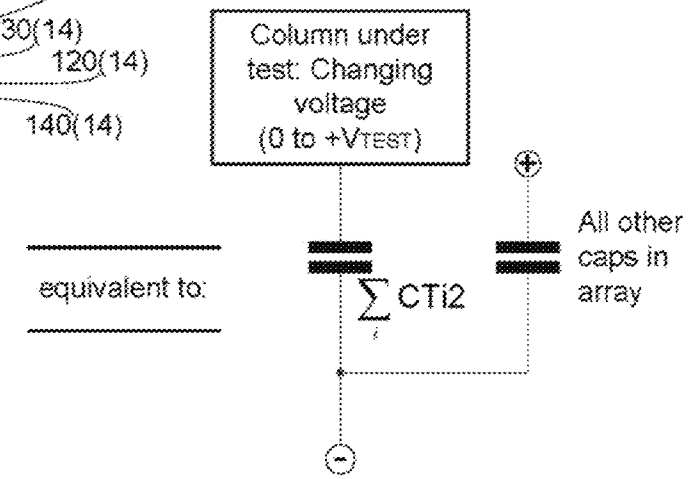
Figure 5:
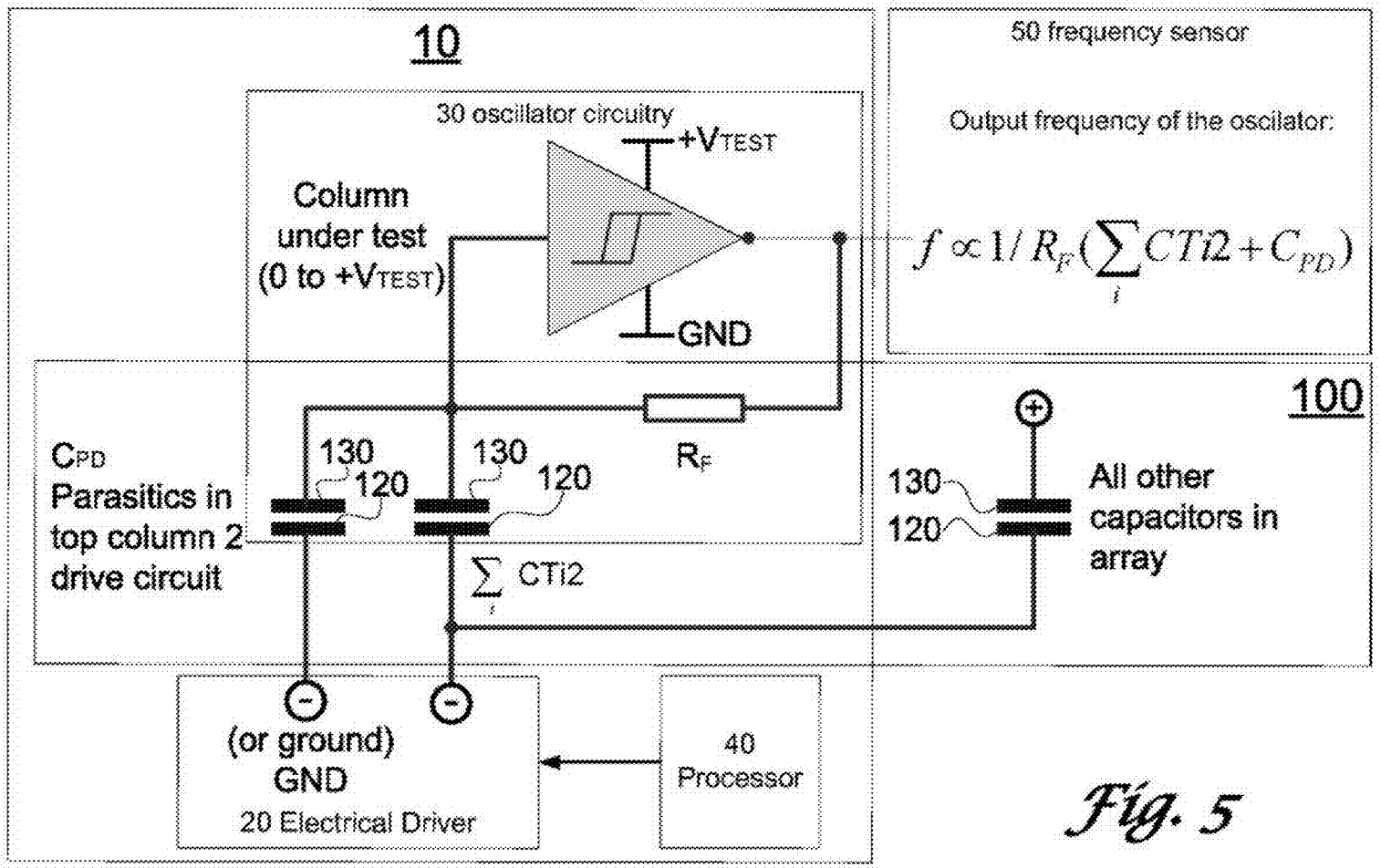
FIG. 5 illustrates an apparatus including a set of operational subunits and a system capable of testing an apparatus according to some embodiments of the present disclosure.

As example, according to an embodiment of the invention, of how such an oscillator may be connected to a tested column (e.g. column 2, as illustrated in FIGS. 3, 4 and 5) is illustrated in column 5. As can be seen in FIG. 5, the output frequency of the illustrated oscillator is proportional to $$f \propto 1 \Big/ R_F\Big(\sum_i CTi2 + C_{PD}\Big),$$

in which $R_F$ is the resistance of the resistance labeled $R_F$, CTi2 is the top-capacitance (with respect to the top electrode, to which the oscillator is connected) of the actuator element number i in the second column. $C_{PD}$ is the residual capacitance, as explained above.

While not necessarily so, the capacitor of the tested actuator element (between its moving element and the top electrode, in this case) may be a part of the oscillator.

In the illustrated example, the electrical connection of the apparatus to the oscillator causes the output frequency of the oscillator to depend on a sum of the capacitances of all of the actuator elements which are included in the same column as the tested actuator element.

Stage 541 includes transferring to the apparatus top-latching-commands for latching moving element ($R_T$,$C_T$) to the top extreme position. This may be done, for example, by relaxing (at least temporarily) the attraction between its moving element and the bottom electrode, and applying a sufficient positive voltage to the top electrode.

Stage 551 includes measuring a testing output frequency of the same oscillator (whose output frequency depends on the position of moving element with respect to its top electrode). The measuring of stage 551 is executed when the top-latching control commands are in effect (and when the location of the moving element ($R_T$,$C_T$)—if functional—is determined by the top-latching control commands).

Stage 561 includes determining a state of the tested actuator element ($R_T$,$C_T$) based on the tested output frequency and on the reference output frequency. The determined state may be a determined position (or estimated position), but may also be another type of state, such as functional/nonfunctional and so on.

For example, stage 561 may include comparing the tested output frequency and the reference output frequency, and if a difference between the two exceeds a predetermined threshold (indicating a substantial change in the capacitance of the tested actuator element), determining that the tested actuator element is in a functional operational state. Likewise, if the difference between the two exceeds a predetermined threshold (indicating the change in the capacitance of the tested actuator element is low, possibly resulting from a stuck or otherwise inoperative moving element), determining that the tested actuator element is in a nonfunctional operational state. Likewise, It should be noted that the order of the measuring of the tested output frequency and of the reference output frequency may be reversed, requiring that the order of latching command will be changed accordingly.

Furthermore, variations of method 501 may be devised where more than one actuator element is tested in a single step, reducing the time required to test the entire array. For example, the controller may transfer bottom-latching control commands for more than one actuator element to be tested in step 521, and top-latching control commands for those same actuator elements to be tested in step 541. In step 561, the controller may then compare the difference between the oscillator output frequencies measured in steps 531 and 551 versus an expected frequency difference corresponding to the number of actuator elements being tested. If said frequency difference is within an expected range, indicating that all the tested actuator elements function as expected, no further testing is necessary. Only if said frequency difference is outside said expected range, further testing is required to determine the state of individual actuator elements within the group of tested actuator elements. Where said frequency difference is outside an expected range, indicating a fault in one or more actuator elements, the controller may test successively smaller groups of actuator elements until the fault or faults have been located, for example, using a recursive search algorithm.

In a further variation of method 500, step 531 may be omitted and step 551 repeated several times, such that at each repetition, a different subset of actuator elements are latched in the top position, but the number of actuator elements latched in the top position is the same. The controller may then compare the oscillator output frequencies measured at each repetition directly against each other (i.e. without the reference measurement provided by step 531 in method 500), and infer information regarding the state of actuator elements from differences in the oscillator output frequencies measured at each repetition of step 551. When said differences in the oscillator output frequencies indicate a fault in one or more actuator elements within a subset of actuator elements, the controller may then identify these actuator elements by testing successively smaller groups of actuator elements as previously described.

Figure 7:
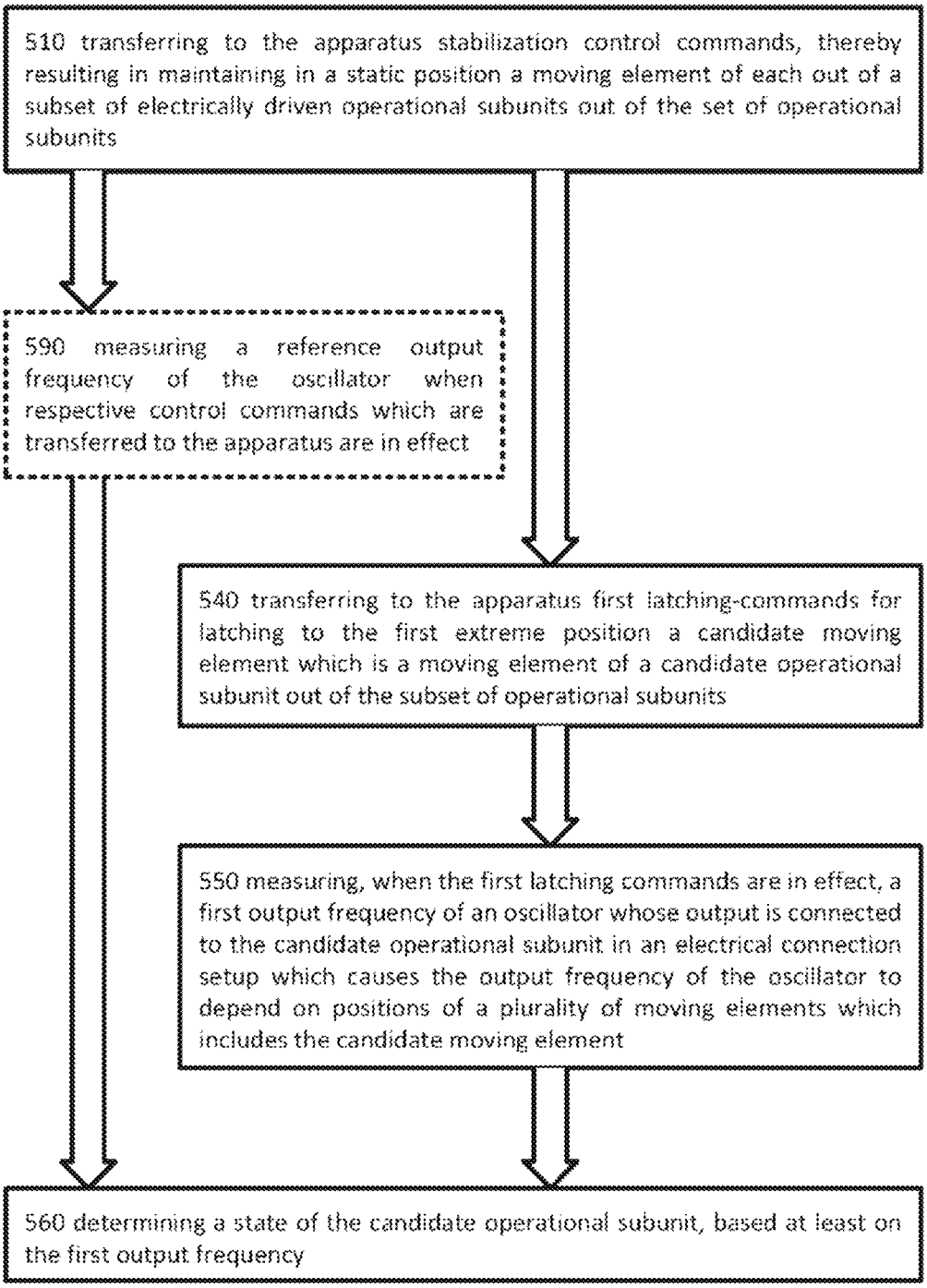
FIG. 7 is a flow chart of a method for testing an apparatus which includes a set of operational subunits according to some embodiments of the present disclosure.

FIG. 7 is a flow chart of method 500 for testing an apparatus which includes a set of operational subunits (e.g. actuator elements), each of the operational subunits includes a moving element, wherein each of the moving elements moves between respective first and second extreme positions. As will be clear, method 501 is a private case of method 500. Likewise, stage 511 is a private case of stage 510, and so on.

Stage 510 of method 500 includes transferring to the apparatus stabilization control commands, thereby resulting in maintaining in a static position a moving element of each out of a subset of electrically driven operational subunits out of the set of operational subunits. While the stabilization control commands may be transferred to the entire array, this is not necessarily so, and it may depend, for example, on the degree to which the capacitance of remote operational subunits affect the capacitance which is reflected in the output frequency of the oscillator.

It should be noted that such static position may be motionless, but that in some implementations some slight movements are still considered to be a static position. The degree to which movement is restricted in such static position may be determined based on the specific implementations (for example—sensitivity desired). For example, when a moving element is in a static position, its freedom of movement may be restricted to 1% of the possible movement between the first and the second extreme positions (other values may alternatively be used, e.g. 2%, 5%). In another approach to motion restriction, when a moving element is in a static position, the electrical effects of its motion on a capacitance of the actuator elements of which it is part may be restricted below 1% (other values may alternatively be used, e.g. 2%, 5%).

It is nevertheless noted that in some implementations, the static position may be static for any practical purpose. For example, if the moving element is forced by an electrostatic force against a mechanical barrier (e g Dimples 210 or 220 in FIG. 2), it is motionless for all practical uses (assuming a sufficiently powerful electrostatic force which overcomes mechanical forces such as these which may be applied by the membrane, by motion of the entire apparatus, etc.).

It is noted that stabilization control commands may be continuously transferred (or otherwise applied) to the apparatus until the measurement of the output frequency (or frequencies) which are required for the determining of stage 560 are carried out, or at least while these measurements are executed. However, different stabilization commands may be transferred from time to time.

The transferring of the stabilization control commands and the first (and second, if implemented) latching control commands may be implemented by continuously applying voltages to electrical connections of the apparatus.

Referring to the examples set forth with respect to the previous drawings, the transferring of the stabilization control commands as well as the latching control commands or other control commands in the following stages may be carried out by electrical driver 20, possibly under the control of processor 40.

Stage 520 and 530 are optional, and will be discussed with respect to FIG. 8. However, generally method 500 may include an optional stage (denoted 590) of measuring a reference output frequency of the oscillator (discussed below), when respective control commands which are transferred to the apparatus are in effect. In such case, the location of the candidate moving element is supposedly determined (if the candidate moving element is functional) by respective control commands transferred to the apparatus. Stages 520 and 530, if implemented, may be part of stage 590.

Method 500 may include reiterating the testing (resulting in the determining of the state) for multiple groups of candidate operational subunits (each including one or more subunits). Especially, for each of this tested group stages 540, 550 and 560 (transferring first latching-commands, measuring a first output frequency, and determining a state of the respective operational subunits) are carried out independently.

However, one measurement of the reference output frequency of stage 590 may be used as a reference frequency for multiple such tested groups of candidate operational subunits. Referring to the example of FIG. 6, the state of the apparatus in stages 521 and 531 (e.g. all moving elements are brought—if functional—to the bottom extreme position, e.g. the bottom electrode or a position near it) may be the same for all of the subunits tested (or at least to all of the subunits of the same column or C-subset).

The reference output frequency may therefore be measured once and stored (e.g. in processor 40). The processor may then compare the output frequency value of each moving element under test to the stored data and thus be able to determine the state of the moving element.

Stage 540 includes transferring to the apparatus first latching-commands for latching to the first extreme position a candidate moving element which is a moving element of a candidate operational subunit out of the subset of operational subunits. The transferring of the first latching-commands in stage 540 may be part of the transferring of the stabilization control commands in stage 510, and the first latching-commands themselves may be part of the stabilization control commands.

It is noted that while the voltages the most of the operational subunit may be determined by electrical driver 20, latching voltage to the candidate operational subunit (and possibly also to electrically connected units such as these of the same column) may be provided by the oscillator itself. For example, the transferring of the first and/or the second latching-commands may include transferring to the candidate operational subunit varying voltage from an output of a nonlinear switching circuit which is connected to the candidate operational subunit.

For example, in the system illustrated in FIG. 5 the latching voltage is provided via resistor $R_F$.

Stage 550 includes measuring, when the first latching control commands are in effect, a first output frequency of an oscillator whose output is connected to the candidate operational subunit in an electrical connection setup which causes the output frequency of the oscillator to depend on positions of a plurality of moving elements which includes the candidate moving element. The plurality of moving elements whose positions affect the output frequency of the oscillator may include, for example, the moving elements of all of the operational subunits in the same columns (if the operational subunits are arranged at columns at all).

Stage 550 may include measuring the first output frequency of the oscillator when a location of the candidate moving element is determined by the first latching control commands. It is noted that the location of the candidate moving element is not necessarily determined by the first latching control command (or other applicable latching control commands) even when the latter are in effect. For example, if the candidate moving element is completely stuck, then it cannot respond to the latching commands. However, even for non-functional (or otherwise defective) moving elements, their location may be determined by respective latching control commands when in effect—for example, the latching command may bring the respective moving element closer to its target location, but not manage to bring it all the way to that target location.

Referring to the examples set forth with respect to the previous drawings, the oscillator may be oscillator 30, and the measuring of its output frequency (in this stage or in optional stage 530 or 590) may be carried out by frequency sensor 50 (which may be part of processor 40 or connected thereto) or by processor 40 itself.

It should be noted that the accuracy of the measurements of frequency may depend on the duration of the measurements, and that the overall duration of the testing methods discussed may depend on such accuracy level desired.

Stage 560 includes determining a state of the candidate operational subunit, based at least on the first output frequency. If stage 590 is executed, the determining may be further based on the measured reference output frequency. It is noted that several reference output frequencies may be measured in stage 590. The determined state may be a determined position (or estimated position), but may also be another type of state, such as functional/nonfunctional and so on. Referring to the examples set forth with respect to the previous drawings, stage 560 may be carried out by processor 40.

The determining of the state may include determining a presence of a defect in the candidate operational subunit. The type of defect may also be determined, but this is not necessarily so.

Figure 8:
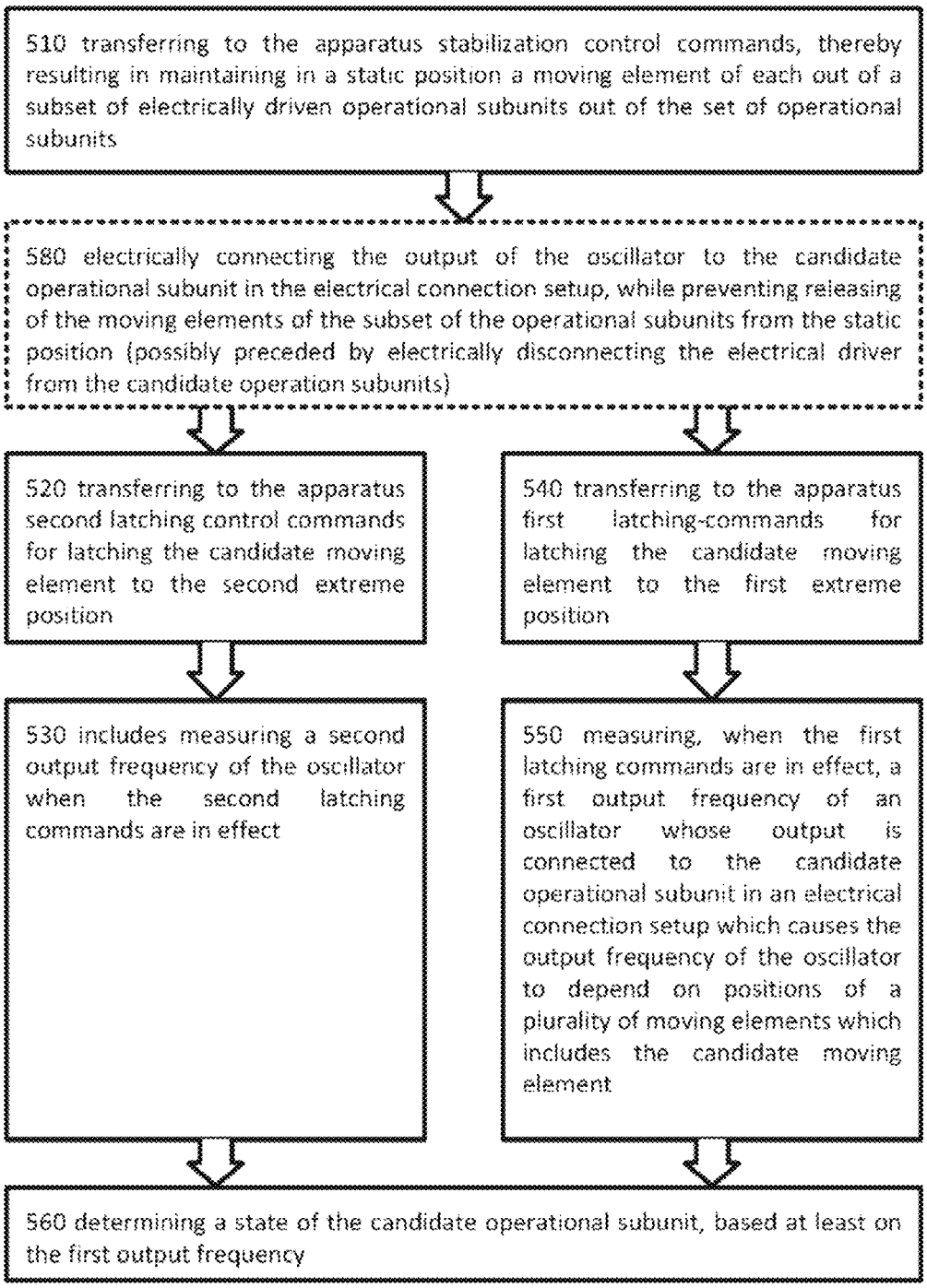
FIG. 8 illustrates an embodiment of a method for testing an apparatus which includes a set of operational subunits.

FIG. 8 illustrates method 500 according to an embodiment in which stages 520 and 530 are executed. Optional stage 520 includes transferring to the apparatus second latching control commands for latching the candidate moving element to the second extreme position. Optional stage 530 includes measuring a second output frequency of the oscillator when the second latching control commands are in effect. In such a case, the determining of stage 560 is further based on the second output frequency (i.e. in addition to the first output frequency). As mentioned with respect to method 501, the temporal relationships between these two measurements and respective commands may vary.

Stage 550 may include measuring the second output frequency of the oscillator when the location of the candidate moving element is determined by the second latching control commands. It is noted that the location of the candidate moving element is not necessarily determined by the second latching control command (or other applicable latching control commands) even when the latter are in effect, but that it may be so determined even in cases when the candidate moving element is not fully functional.

Referring to method 500 as a whole, it is noted that in different testing schemes, the stabilization control commands may be designed to maintain different moving elements in different static positions with respect to their operational subunits.

When measuring the first output frequency, only a subset of tested-operational subunits may be controllably brought towards the first extreme position. That is, optionally, the measuring of the first output frequency may include measuring the first output frequency when a target location of each out of a tested-subset of moving elements which includes the candidate moving element is determined by commands for latching the tested-subset of moving elements to the first extreme position and when a target location of each out of a complementary subset of moving elements (i.e. which includes all moving elements of the set of operational subunits of the apparatus, or at least these of the same C-subset) except the tested-subset of moving elements, is determined by commands for latching the complementary subset of moving elements to the second extreme position.

It is noted that, optionally, the measuring of the first output frequency may include measuring the first output frequency when a location of each out of a tested-subset of moving elements which includes the candidate moving element (or at least—the location of each non-defective moving element of the tested-subset) is determined by commands for latching the tested-subset of moving elements to the first extreme position and when a location of each out of a complementary subset of moving elements (i.e. which includes all moving elements of the set of operational subunits of the apparatus, or at least these of the same C-subset) except the tested-subset of moving elements, is determined by commands for latching the complementary subset of moving elements to the second extreme position (or at least—the location of each non-defective moving element of the complementary-subset).

Referring to stage 540, optionally the transferring of the first latching control commands may include transferring to the apparatus the first latching-commands for latching to the first extreme position the moving elements of a tested-subset of at least one of the set of operational subunits which includes the candidate operational subunit (e.g. the tested-subset may include only one tested moving elements, two moving elements in the same column, etc.). The transferring of the stabilization control commands in such case may include transferring third latching control commands for latching to the second extreme position all moving elements of the set of operational subunits (or at least of the same column or more generally—the same C-subset) except the moving elements of the tested-subset of operational subunits.

The number of operational subunits whose moving element are included in the tested-subset imply the number of operational subunits is tested in a single time. While the tested-subset of moving elements may consists of only the single candidate moving element, in other implementations larger numbers may be tested together. For example, operational subunits may be tested in batches of 4 subunits, and only if the batch is found (or suspected) defective, its operational subunits will be tested individually. This may depend, among other factors, on the sensitivity of the measurement in different constellations.

As aforementioned, the control commands (in the form of varying voltage) may be supplied to the candidate operational subunit from an output of a nonlinear switching circuit which is part of the oscillator that is electrically connected to the candidate operational subunit. This may require disconnecting other units which regularly are configured and connected for providing voltage in routine operation (such as the electrical driver 20).

It is noted that before stages 520 and/or 540 are executed, method 500 may include an optional stage 580 of electrically connecting the output of the oscillator to the candidate operational subunit in the electrical connection setup, while preventing releasing of the moving elements of the subset of the operational subunits from the static position.

During the testing of a given operational subunit, the voltage difference between the electrode and the moving element stays above the minimum needed to keep the membrane latched. Referring to the example of FIG. 5 it is noted that the negative power supply rail of the inverting Schmitt trigger (grey triangle) is ground (GND), and that therefore it cannot output negative voltages.

Optionally (e.g. as in the illustrated example), the C-subset (in this case—column) which includes the tested operational subunit (or subunits), and all the A-electrodes in that column, is at ≥0 Volts. All R-subsets (in this case—row), and moving elements connected to them, are held at a negative voltage. Therefore, for every operational subunit in the C-subset under test, we have a potential difference between electrode and moving element of either V0 (if Schmitt trigger output is low) or V0+Vtest (if Schmitt trigger output is high). By definition, V0 is sufficient to keep latched elements latched. For moving elements in other C-subsets, the electrodes are held at a positive voltage and the moving elements at a negative voltage, so that the voltage difference is greater than V0 and which is therefore also sufficient to keep moving elements latched.

Stage 580 may also include disconnecting another controller (e.g. electrical driver 20) before connecting the oscillator. That is, stage 580 may include electrically disconnecting the electrical driver from the candidate operation subunits (and possibly from other subunits as well, e.g. units of the same column, the same C-subset, etc.).

The disconnecting may be implemented using Tri-stating, and more specifically, by tri-stating the output of the electrical driver 20 before connecting the parts of the oscillator external to the operational subunit. This may be achieved by using an electrical driver 20 which has two switch-like circuit elements (such as transistors) for each C-subset, one to connect the column to the positive voltage used (as shown in the figure) and one to connect it to ground (0 Volts).

Turning both transistors off results in that the C-subset is floating, and then the other parts of the oscillator is connected. These external parts of the oscillator may also be connected/disconnected using the same method—for example, if the output of the inverting Schmitt trigger shown in FIG. 5 is capable of being tri-stated (feedback resistor RF may then remain connected to the column even when not testing, but that doesn't interfere with normal operation).

Referring to method 500 as a whole, optionally the electrical connection setup (of the oscillator) causes the output frequency of the oscillator to depend on capacitances of a plurality of operational subunits which includes the candidate operational subunit. The output frequency naturally depends on other factors as well (e.g. capacitance of additional components in the electronic circuit, such as other parts of the apparatus, e.g. between different operational subunits).

While methods 500 and 501 where discussed for testing a single group of operational subunits, as was suggested above these processes may be repeated for many operational subunits (e.g. of different rows; of different columns), and or for different capabilities of the same (or other) operational subunits, such as movement towards the first extreme position and movement towards the second extreme position.

That is, method 500 (and likewise method 501) may further include reiterating for each out of a group of multiple candidate moving elements the stages of: transferring stabilization control commands, transferring first latching-commands, measuring a first output frequency, and determining a state of the candidate operational subunit.

Additionally, method 500 (and likewise method 501) may further include reversing the direction of the testing the method (between the first and second extreme positions), and executing for the same group of one or more tested candidate moving elements the stages of: transferring stabilization control commands (e.g. opposite in direction), transferring second latching-commands, measuring a second output frequency, and determining a state of the candidate operational subunit based on at least the second output frequency.

As aforementioned, the operational subunits may be divided into rows and columns, and more generally to R-subsets and to C-subsets, as discussed below. Optionally, the set of operational subunits includes a multiplicity of electrostatic operational subunits, each including a moving element moving between first and second electrodes, the multiplicity of electrostatic operational subunits including Nr first subsets (R-subsets) of operational subunits and Nc second subsets (C-subsets) of operational subunits, wherein a first partitioning of the multiplicity of operational subunits yields the Nr first subsets (R-subsets) and a second partitioning of the multiplicity of operational subunits yields the Nc second subsets (C-subsets); wherein the apparatus further includes:

- a first plurality of Nr electrical connections (R-wires) interconnecting the moving elements of operational subunits in each R-subset, such that the moving element of any operational subunit in each individual R-subset is electrically connected to the moving elements of all other operational subunits in the individual R-subset, and electrically isolated from the moving elements of all operational subunits not in the individual R-subset;
- a second plurality of Nc electrical connections (A-wires) interconnecting the first electrodes of operational subunits in each C-subset, such that the first electrode of any operational subunit in each individual C-subset is electrically connected to the first electrode of all other operational subunits in the individual C-subset, and electrically isolated from all operational subunits not in the individual C-subset; and possibly also
- a third plurality of Nc electrical connections (B-wires) interconnecting the second electrodes of operational subunits in each C-subset, such that the second electrode of any operational subunit in each individual C-subset is electrically connected to the second electrode of all other operational subunits in the individual C-subset, and electrically isolated from all operational subunits not in the individual C-subset;

In such a configuration, the electrical connection setup may be designed so as to cause the output frequency of the oscillator to depend on a sum of the capacitances of Nr operational subunits which are included in the C-subset which includes the candidate operational subunit.

These testing methods may be used for the testing of tested apparatuses of various kinds and of various functionalities.

For example, the apparatus may be an apparatus for generating a target physical effect, at least one attribute of which corresponds to at least one characteristic of a digital input signal sampled periodically. For example, the apparatus may be a speaker whose audio output have at least one attribute (e.g. volume, frequency) that corresponds to at least one characteristic of a digital input signal sampled periodically.

Optionally, some or all of the moving elements of the apparatus are configured to create sound pressure waves in a fluid.

Optionally, some or all of the moving elements of the apparatus are configured to create sound pressure pulses in a fluid.

Optionally, some or all of the moving elements of the apparatus may be part of a sensor which are moved during method 500 for the purpose of testing its functionality (i.e. of that sensor).

Optionally, some or all of the moving elements of the apparatus may be part of a sensor which are moved during method 500 for the purpose for the purpose of calibration of that sensor.

Reverting to system 10 (illustrated in FIGS. 3, 4, and 5), system 10 includes at least electrical driver 20, oscillator circuitry 30, and processor 40.

The electrical driver, which is electrically connected to the apparatus, is configured at least to: (a) transfer to the apparatus stabilization control commands, thereby resulting in maintaining in a static position a moving element of each out of a subset of electrically driven operational subunits (e.g. operational subunits) out of the set of operational subunits (possibly in the entire array, but not necessarily so); and (b) transfer to the apparatus first latching-commands for latching to the first extreme position a candidate moving element which is a moving element of a candidate operational subunit out of the subset of operational subunits (possibly as part of the above). Optionally, the electrical driver may be further configured to transfer to the apparatus (at other times) second latching control commands for latching the candidate moving element to the second extreme position.

Oscillator circuitry 30 is configured to be connected to the candidate operational subunit in an electrical connection setup which causes the output frequency of the oscillator circuitry to depend on positions of a plurality of moving elements which includes the candidate moving element. It is noted that the term "oscillator circuitry" may exclude parts of the oscillator which are included in the apparatus (e.g. in the Microelectromechanical systems, MEMS, in which the apparatus is implemented). However, when applicable this term may also include circuitry parts which are parts of the apparatus (i.e. which serve for the routine operation of the apparatus—e.g. for the production of sound if the apparatus is a speaker).

Processor 40 is configured to: (a) determine a first output frequency of the oscillator circuitry based on output of the oscillator circuitry when the first latching control commands are in effect; and (b) to determine a state of the candidate operational subunit based on the first output frequency.

For example, processor 40 may be configured to obtain the first output frequency of the oscillator circuitry based on output of the oscillator circuitry when a location of the candidate moving element is determined by the first latching control commands.

For example, processor 40 may be configured to determine a presence of a defect in the candidate operational subunit by determining its state (i.e., the state determined by processor 40 is—or includes—its operational/defectiveness state).

Notably, system 10 may include apparatus 100, but this is not necessarily so. System 10 (or at least some components of it) may be detachably connectable to apparatus 100, or impermanently connected thereto.

Optionally, processor 40 may be further configured to issue the stabilization control commands.

It is noted that units 20, 30, 40 and/or 50 may be implemented on the tested apparatus or externally to it. The first approach may be used, for example, for an "on-chip" testing approach. In such case the processor 40 may be the same controller which transmits control commands to the apparatus for producing a physical effect by the controlled motion of the moving elements (e.g. sounds). The latter approach may be used, for example, using FAB (fabrication facility) testing equipment. In such case the processor 40 may be a simpler unit, because it does not necessarily have to be able to control the production of such physical effect.

Optionally, electrical driver 20 may be further configured to transfer to the apparatus second latching control commands for latching the candidate moving element to the second extreme position, wherein the processor is configured to determine a second output frequency of the oscillator circuitry based on output of the oscillator circuitry when the second latching control commands are in effect; and to determine the state of the candidate operational subunit based on the first output frequency and on the second output frequency. The order in which this measurements are executed may vary.

Optionally, electrical driver 20 may be further configured to transfer to the apparatus second latching control commands for latching the candidate moving element to the second extreme position, wherein the processor is configured to obtain a second output frequency of the oscillator circuitry based on output of the oscillator circuitry when the location of the candidate moving element is determined by the second latching control commands; and to determine the state of the candidate operational subunit based on the first output frequency and on the second output frequency. The order in which this measurements are executed may vary.

Optionally, electrical driver 20 may be configured to transfer to the apparatus the stabilization control commands and the first latching control commands by continuously applying voltages to electrical connections of the apparatus.

Optionally, electrical driver 20 may be configured to transfer to the candidate operational subunit the first latching-commands which include varying voltage from an output of a nonlinear switching circuit of the oscillator circuitry which is connected to the candidate operational subunit (e.g. as discussed above).

Optionally, processor 40 may be configured to determine the first output frequency based on output of the oscillator circuitry when a target location of each out of a tested-subset of moving elements which includes the candidate moving element is determined by commands for latching the tested-subset of moving elements to the first extreme position and when a target location of a complementary subset of moving elements, which includes all moving elements of the set of operational subunits except the tested-subset of moving elements, is determined by commands for latching the complementary subset of moving elements to the second extreme position.

Optionally, processor 40 may be configured to determine the first output frequency based on output of the oscillator circuitry when a location of each out of a tested-subset of moving elements which includes the candidate moving element (or at least—the location of each non-defective moving element of the tested-subset) is determined by commands for latching the tested-subset of moving elements to the first extreme position and when a location of a complementary subset of moving elements (or at least—the location of each non-defective moving element of the complementary-subset), which includes all moving elements of the set of operational subunits except the tested-subset of moving elements, is determined by commands for latching the complementary subset of moving elements to the second extreme position.

Optionally, the transferring of the first latching control commands may include transferring to the apparatus the first latching-commands for latching to the first extreme position the moving elements of a tested-subset of at least one of the set of operational subunits which includes the candidate operational subunit, wherein the transferring of the stabilization control commands includes transferring third latching control commands for latching to the second extreme position all moving elements of the set of operational subunits except the moving elements of the tested-subset of operational subunits). For example, the tested-subset of moving elements may consist of the single candidate moving element.

As aforementioned, the oscillator circuitry may be selectively electrically disconnected from the set of operational subunits.

Optionally, the electrical connection setup may cause the output frequency of the oscillator circuitry to depend on capacitances of a plurality of operational subunits which includes the candidate operational subunit.

System 10 may repeat the testing for multiple operational subunits in different times. For example, oscillator circuitry 30 may be connected to different operational subunits in different times, and processor 40 may be configured to determine states of multiple operational subunits based on output frequencies of the oscillator circuitry in the different times. Sequential testing of movement in both directions (towards the first and the second extreme positions) may also be implemented.

Optionally, the apparatus tested by system 10 may be an apparatus for generating a target physical effect, at least one attribute of which corresponds to at least one characteristic of a digital input signal sampled periodically. For example, the apparatus may be a speaker whose audio output have at least one attribute (e.g. volume, frequency) that corresponds to at least one characteristic of a digital input signal sampled periodically. Optionally, some or all of the moving elements of the apparatus are configured to create sound pressure waves in a fluid. Optionally, some or all of the moving elements of the apparatus are configured to create sound pressure pulses in a fluid.

Optionally, some or all of the moving elements of the apparatus may be part of a sensor which are moved during the testing by system 10 for the purpose of testing its functionality (i.e. of that sensor).

Optionally, some or all of the moving elements of the apparatus may be part of a sensor which are moved during the testing by system 10 for the purpose for the purpose of calibration of that sensor.

Referring to method 500 and 501 and to system 10 generally, it is noted that while testing of operational subunits out of a plurality of subunits was disclosed, testing of a single moving element of a system which includes only an independent moving element which is not electrically dependent on other moving elements may be implemented in a similar way, and is included in the scope of this description. For example, the moving element of a sensor which includes such a solitary moving element (used for the sensing) may be actuated for self test—to test for reaching end of travel using frequency to detect the max capacitance.

Referring to method 500 and 501 and to system 10 generally, it is noted that output frequency of the oscillator may be measured and used to determine (or at least estimate) the position of a moving element rather than its final latched position. For example, the ratio between the first and the second measured output frequency may be indicative of such locations—especially if compared to the results of the testing of other operational subunits of the same apparatus.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

It will be appreciated that the embodiments described above are cited by way of example, and various features thereof and combinations of these features can be varied and modified.

For example, the embodiments described above also apply to electrostatic actuators consisting of one moving plate and one stationary plate and to comb drive electrostatic actuators consisting of a static comb shape electrode (stator) and a moving comb shaped electrode (rotor).

While various embodiments have been shown and described, it will be understood that there is no intent to limit the invention by such disclosure, but rather, it is intended to cover all modifications and alternate constructions falling within the scope of the invention, as defined in the appended claims.

What is claimed is:

1. A method for testing an apparatus which comprises a set of operational subunits, each of the operational subunits comprising a moving element, wherein each of the moving elements moves between respective first and second extreme positions, the method comprising:

transferring to the apparatus stabilization control commands by an electrical driver electrically coupled to the apparatus, thereby resulting in maintaining in a static position a moving element of each out of a subset of electrically driven operational subunits out of the set of operational subunits;

transferring to the apparatus, by said electrical driver, first latching-commands for latching to the first extreme position a candidate moving element which is a moving element of a candidate operational subunit out of the subset of operational subunits;

when the first latching control commands are in effect, measuring a first output frequency of an oscillator whose output is coupled to the candidate operational subunit in an electrical coupling setup which causes the output frequency of the oscillator to depend on positions of a plurality of moving elements which comprises the candidate moving element;

based on the first output frequency determining, by a processor, a state of the candidate operational subunit; and wherein the determining of the state comprises determining a presence of a defect in the candidate operational subunit by said processor.

2. The method according to claim 1, wherein the measuring of the first output frequency of the oscillator is executed when a location of the candidate moving element is determined by the first latching control commands.

3. The method according to claim 1 where the set of operational subunits consists of a single subunit.

4. The method according to claim 1, wherein the determining of the state comprises determining a position of the moving element of the candidate operational subunit.

5. The method according to claim 1, comprising transferring to the apparatus second latching control commands for latching the candidate moving element to the second extreme position, and measuring a second output frequency of the oscillator when the second latching control commands are in effect; wherein the determining of the state of the candidate operational subunit is further based on the second output frequency.

6. The method according to claim 5, wherein the measuring of the second output frequency of the oscillator when the location of the candidate moving element is determined by the second latching control commands.

7. The method according to claim 1, comprising transferring to the apparatus the stabilization control commands and the first latching control commands by continuously applying voltages to electrical couplings of the apparatus.

8. The method according to claim 7 wherein the transferring of the first latching-commands comprises transferring to the candidate operational subunit varying voltage from an output of a nonlinear switching circuit which is coupled to the candidate operational subunit.

9. The method according to claim 1, wherein the measuring of the first output frequency comprises measuring the first output frequency when a target location of each out of a tested-subset of moving elements which comprises the candidate moving element is determined by commands for latching the tested-subset of moving elements to the first extreme position and when a target location of each out of a complementary subset of moving elements, which comprises all moving elements of the set of operational subunits except the tested-subset of moving elements, is determined by commands for latching the complementary subset of moving elements to the second extreme position.

10. The method according to claim 9, wherein the tested-subset of moving elements consists of the candidate moving element.

11. The method according to claim 1, further comprising electrically coupling the output of the oscillator to the candidate operational subunit in the electrical coupling setup, while preventing releasing of the moving elements of the subset of the operational subunits from the static position.

12. The method according to claim 1, wherein the electrical coupling setup causes the output frequency of the oscillator to depend on capacitances of a plurality of operational subunits which comprises the candidate operational subunit.

13. The method according to claim 1, wherein the set of operational subunits comprises a multiplicity of electrostatic operational subunits, each including a moving element moving between first and second electrodes, the multiplicity of electrostatic operational subunits including Nr first subsets (R-subsets) of operational subunits and Nc second subsets (C-subsets) of operational subunits, wherein a first partitioning of the multiplicity of operational subunits yields the Nr first subsets (R-subsets) and a second partitioning of the multiplicity of operational subunits yields the Nc second subsets (C-subsets); wherein the apparatus further comprises:

a first plurality of Nr electrical connections (R-wires) interconnecting the moving elements of operational subunits in each R-subset, such that the moving element of any operational subunit in each individual R-subset is electrically connected to the moving elements of all other operational subunits in the individual R-subset, and electrically isolated from the moving elements of all operational subunits not in the individual R-subset;

a second plurality of Nc electrical connections (A-wires) interconnecting the first electrodes of operational subunits in each C-subset, such that the first electrode of any operational subunit in each individual C-subset is electrically connected to the first electrode of all other operational subunits in the individual C-subset, and electrically isolated from all operational subunits not in the individual C-subset; and a third plurality of Nc electrical connections (B-wires) interconnecting the second electrodes of operational subunits in each C-subset, such that the second electrode of any operational subunit in each individual C-subset is electrically connected to the second electrode of all other operational subunits in the individual C-subset, and electrically isolated from all operational subunits not in the individual C-subset;

wherein the electrical coupling setup causes the output frequency of the oscillator to depend on a sum of the capacitances of Nr operational subunits which are comprised in the C-subset which comprises the candidate operational subunit.

14. The method according to claim 1, further comprising reiterating for each out of a group of multiple candidate moving elements the stages of: transferring stabilization control commands, transferring first latching-commands, measuring a first output frequency, and determining a state of the candidate operational subunit.

15. The method according to claim 1, wherein the apparatus is an apparatus for generating a target physical effect, at least one attribute of which corresponds to at least one characteristic of a digital input signal sampled periodically.

16. The method according to claim 1, wherein the candidate moving element is configured to create sound pressure waves in a fluid.

17. The method according to claim 1, wherein the candidate moving element is configured to create sound pressure pulses in a fluid.

18. The method according to claim 1, wherein the candidate moving element is a part of a sensor that is actuated for the purpose of testing the functionality of said sensor.

19. The method according to claim 1, wherein the candidate moving element is a part of a sensor that is actuated for the purpose of calibration of said sensor.

20. The method according to claim 8, further comprising electrically decoupling the electrical driver from the candidate operational subunit before the coupling of the output of the oscillator by tri-stating an output of the electrical driver before the coupling of the output of the oscillator.

21. A system capable of testing an apparatus which comprises a set of operational subunits, each of the operational subunits comprising a moving element which moves between first and second extreme positions, the system comprising:

an electrical driver, electrically coupled to the apparatus, configured to:

(a) transfer to the apparatus stabilization control commands, thereby resulting in maintaining in a static position a moving element of each out of a subset of electrically driven operational subunits out of the set of operational subunits; and (b) transfer to the apparatus first latching-commands for latching to the first extreme position a candidate moving element which is a moving element of a candidate operational subunit out of the subset of operational subunits;

oscillator circuitry, configured to be coupled to the candidate operational subunit in an electrical coupling setup which causes the output frequency of the oscillator circuitry to depend on positions of a plurality of moving elements which comprises the candidate moving element; and a processor, configured to:

(a) determine a first output frequency of the oscillator circuitry based on output of the oscillator circuitry when the first latching control commands are in effect; and (b) determine a state of the candidate operational subunit based on the first output frequency;

wherein the processor is configured to determine a presence of a defect in the candidate operational subunit by determining its state.

22. The system according to claim 21 where the set of operational subunits consists of a single subunit.

23. The system according to claim 21, wherein the processor is configured to determine the first output frequency of the oscillator circuitry based on the output of the oscillator circuitry when a target location of the candidate moving element is determined by the first latching control commands.

24. The system according to claim 21, wherein the processor is configured to determine a position of the moving element of the candidate operational subunit by determining its state.

25. The system according to claim 21, further comprising the apparatus which comprises the set of operational subunits.

26. The system according to claim 21, wherein the processor is further configured to determine the stabilization control commands.

27. The system according to claim 21, wherein the electrical driver is further configured to transfer to the apparatus second latching control commands for latching the candidate moving element to the second extreme position, wherein the processor is configured to determine a second output frequency of the oscillator circuitry based on output of the oscillator circuitry when the second latching control commands are in effect; and to determine the state of the candidate operational subunit based on the first output frequency and on the second output frequency.

28. The system according to claim 27, wherein the processor is configured to determine the second output frequency of the oscillator circuitry based on the output of the oscillator circuitry when a location of the candidate moving element is determined by the second latching control commands.

29. The system according to claim 21, wherein the electrical driver is configured to transfer to the apparatus the stabilization control commands and the first latching control commands by continuously applying voltages to electrical couplings of the apparatus.

30. The system according to claim 21, wherein the electrical driver is configured to transfer to the candidate operational subunit the first latching-commands which comprise varying voltage from an output of a nonlinear switching circuit of the oscillator circuitry which is coupled to the candidate operational subunit.

31. The system according to claim 21, wherein the processor is configured to determine the first output frequency based on output of the oscillator circuitry when a target location of each out of a tested-subset of moving elements which comprises the candidate moving element is determined by commands for latching the tested-subset of moving elements to the first extreme position and when a target location of a complementary subset of moving elements, which comprises all moving elements of the set of operational subunits except the tested-subset of moving elements, is determined by commands for latching the complementary subset of moving elements to the second extreme position.

32. The system according to claim 31, wherein the tested-subset of moving elements consists of the candidate moving element.

33. The system according to claim 21, wherein the oscillator circuitry may be selectively electrically decoupled from the set of operational subunits.

34. The system according to claim 21, wherein the electrical coupling setup causes the output frequency of the oscillator circuitry to depend on capacitances of a plurality of operational subunits which comprises the candidate operational subunit.

35. The system according to claim 34, wherein the set of operational subunits comprises a multiplicity of electrostatic operational subunits, each including a moving element moving between first and second electrodes, the multiplicity of electrostatic operational subunits including Nr first subsets (R-subsets) of operational subunits and Nc second subsets (C-subsets) of operational subunits, wherein a first partitioning of the multiplicity of operational subunits yields the Nr first subsets (R-subsets) and a second partitioning of the multiplicity of operational subunits yields the Nc second subsets (C-subsets); wherein the apparatus further comprises:

a first plurality of Nr electrical connections (R-wires) interconnecting the moving elements of operational subunits in each R-subset, such that the moving element of any operational subunit in each individual R-subset is electrically connected to the moving elements of all other operational subunits in the individual R-subset, and electrically isolated from the moving elements of all operational subunits not in the individual R-subset;

a second plurality of Nc electrical connections (A-wires) interconnecting the first electrodes of operational subunits in each C-subset, such that the first electrode of any operational subunit in each individual C-subset is electrically connected to the first electrode of all other operational subunits in the individual C-subset, and electrically isolated from all operational subunits not in the individual C-subset; and a third plurality of Nc electrical connections (B-wires) interconnecting the second electrodes of operational subunits in each C-subset, such that the second electrode of any operational subunit in each individual C-subset is electrically connected to the second electrode of all other operational subunits in the individual C-subset, and electrically isolated from all operational subunits not in the individual C-subset;

wherein the electrical coupling setup causes the output frequency of the oscillator circuitry to depend on a sum of the capacitances of Nr operational subunits which are comprised in the C-subset which comprises the candidate operational subunit.

36. The system according to claim 21, wherein the oscillator circuitry may be coupled to different operational subunits in different times, wherein the processor is configured to determine states of multiple operational subunits based on output frequencies of the oscillator circuitry in the different times.

37. The system according to claim 21, wherein the apparatus is an apparatus for generating a target physical effect, at least one attribute of which corresponds to at least one characteristic of a digital input signal sampled periodically.

38. The system according to claim 21, wherein the candidate moving element is configured to create sound pressure waves in a fluid.

39. The system according to claim 21, wherein the candidate moving element is configured to create sound pressure pulses in a fluid.

40. The system according to claim 21, wherein the candidate moving element is a part of a sensor that is actuated for the purpose of testing the functionality of said sensor.

41. The system according to claim 21, wherein the candidate moving element is a part of a sensor that is actuated for the purpose of calibration of said sensor.

* * * * *